US005548305A

United States Patent [19]

Rupel

[11] Patent Number: 5,548,305

[45] Date of Patent: Aug. 20, 1996

[54] METHOD AND APPARATUS FOR DISPLAYING COLOR ON A COMPUTER OUTPUT DEVICE USING DITHERING TECHNIQUES

[75] Inventor: Wesley O. Rupel, Bellevue, Wash.

[73] Assignee: Microsoft Corporation, Redmond, Wash.

[21] Appl. No.: 820,316

[22] Filed: Jan. 9, 1992

Related U.S. Application Data

[63] Continuation of Ser. No. 430,503, Oct. 31, 1989, Pat. No. 5,138,303.

[51] Int. Cl.[6] ..... G09G 5/02

[52] U.S. Cl. ..... 345/150; 345/152; 345/149

[58] Field of Search ..... 340/703, 701, 340/793; 358/455, 456, 457, 429, 80, 75, 515, 525; 345/149, 147, 150, 152, 153, 154, 155

[56] References Cited

U.S. PATENT DOCUMENTS

| | | | |
|---|---|---|---|
| 4,626,835 | 12/1986 | Nienaber et al. | 340/703 |
| 4,635,078 | 1/1987 | Sakurada et al. | 358/75 |
| 4,680,625 | 7/1987 | Shoji et al. | 358/80 |
| 4,837,613 | 6/1989 | Paxton et al. | 340/701 |
| 4,860,026 | 8/1989 | Matsumoto et al. | 358/75 |
| 4,897,736 | 1/1990 | Sugino | 358/75 |
| 4,901,603 | 3/1990 | Hirahara et al. | 358/457 |
| 4,970,586 | 11/1990 | Sunda et al. | 358/80 |

*Primary Examiner*—Richard Hjerpe
*Assistant Examiner*—Xiao M. Wu
*Attorney, Agent, or Firm*—Seed and Berry

[57] ABSTRACT

A method and apparatus for filling an area of a computer display with a preselected color is provided. Typical computer systems software provides the capability to represent 256 different intensities of a color. However, many color displays cannot support the displaying of 256 intensity levels. The present invention provides a method and apparatus for mapping the higher number of intensity levels supported by the systems software to the lower number of intensity levels actually supported by the display. In a preferred embodiment, four picture elements (pels) of a display are logically grouped together to create a super-pel. By varying the intensity level in each pel of a super-pel, the effective number of intensity levels for a given color can be increased.

18 Claims, 6 Drawing Sheets red = 190, green = 130, blue = 25 mapped_red := 6
mapped_green := 4
mapped_blue := 1
max_mapped := 6
intensity := 2
table := 2-by-2_table

| | Pel1 | | Pel2 | | Pel3 | | Pel4 | | |
|---|---|---|---|---|---|---|---|---|---|
| red point count := | 2 | + | 1 | + | 1 | + | 2 | = | 6 |
| green point count := | 2 | + | 0 | + | 0 | + | 2 | = | 4 |
| blue point count := | 0 | + | 1 | + | 0 | + | 0 | = | 1 |

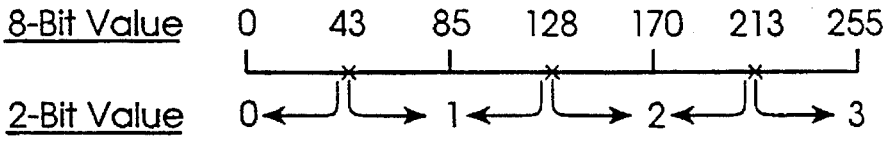
Figure 1
RGB = (0, 0, 128)
| | | | | | | | |
|---|---|---|---|---|---|---|---|
| 2 | 2 | 2 | 2 | 2 | 2 | 2 | 2 |
| 2 | 2 | 2 | 2 | 2 | 2 | 2 | 2 |
| 2 | 2 | 2 | 2 | 2 | 2 | 2 | 2 |
| 2 | 2 | 2 | 2 | 2 | 2 | 2 | 2 |
| 2 | 2 | 2 | 2 | 2 | 2 | 2 | 2 |
| 2 | 2 | 2 | 2 | 2 | 2 | 2 | 2 |
| 2 | 2 | 2 | 2 | 2 | 2 | 2 | 2 |
| 2 | 2 | 2 | 2 | 2 | 2 | 2 | 2 |
Figure 2
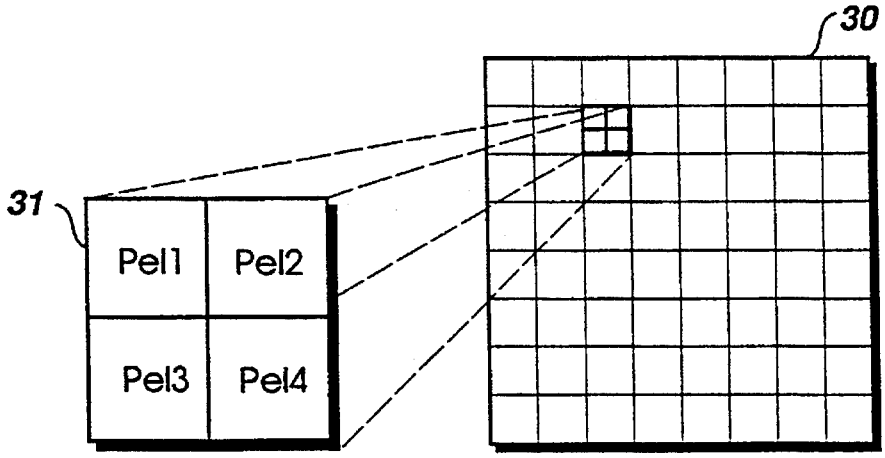
Figure 3

RGB = (0, 0, 128)

(2, 1, 1, 2)

Pel 1
Pel 2
Pel 3
Pel 4

| | | | | | | | |
|---|---|---|---|---|---|---|---|
| 2 | 1 | 2 | 1 | 2 | 1 | 2 | 1 |
| 1 | 2 | 1 | 2 | 1 | 2 | 1 | 2 |
| 2 | 1 | 2 | 1 | 2 | 1 | 2 | 1 |
| 1 | 2 | 1 | 2 | 1 | 2 | 1 | 2 |
| 2 | 1 | 2 | 1 | 2 | 1 | 2 | 1 |
| 1 | 2 | 1 | 2 | 1 | 2 | 1 | 2 |
| 2 | 1 | 2 | 1 | 2 | 1 | 2 | 1 |
| 1 | 2 | 1 | 2 | 1 | 2 | 1 | 2 |

Figure 4a

| 1 | 2 |
|---|---|
| B | B |
| B | B+1 |

3 4

Figure 4b

| 1 | 2 |
|---|---|
| B+1 | B |
| B | B+1 |

3 4

Figure 4c

| 1 | 2 |
|---|---|
| B+1 | B |
| B+1 | B+1 |

3 4

Figure 4d

RGB = (0, 0, 128)

| | | | | | | | |
|---|---|---|---|---|---|---|---|
| 1 | 2 | 1 | 2 | 1 | 2 | 1 | 2 |
| 1 | 2 | 1 | 2 | 1 | 2 | 1 | 2 |
| 1 | 2 | 1 | 2 | 1 | 2 | 1 | 2 |
| 1 | 2 | 1 | 2 | 1 | 2 | 1 | 2 |
| 1 | 2 | 1 | 2 | 1 | 2 | 1 | 2 |
| 1 | 2 | 1 | 2 | 1 | 2 | 1 | 2 |
| 1 | 2 | 1 | 2 | 1 | 2 | 1 | 2 |
| 1 | 2 | 1 | 2 | 1 | 2 | 1 | 2 |

Figure 5 red = 190, green = 130, blue = 25 mapped_red := 6
mapped_green := 4
mapped_blue := 1
max_mapped := 6
intensity := 2
table := 2-by-2_table

| | Pel1 | | Pel2 | | Pel3 | | Pel4 | | |
|---|---|---|---|---|---|---|---|---|---|
| red point count | := 2 | + | 1 | + | 1 | + | 2 | = | 6 |
| green point count | := 2 | + | 0 | + | 0 | + | 2 | = | 4 |
| blue point count | := 0 | + | 1 | + | 0 | + | 0 | = | 1 |

2-by-4_table

| intensity \ mapped_intensity | 0 | 1 | 2 | 3 | 4 | 5 | 6 | 7 | 8 |
|---|---|---|---|---|---|---|---|---|---|
| 0 | 0 0 0 0<br>0 0 0 0 | 0 1 0 0<br>0 0 0 1 | 1 1 0 0<br>0 0 1 1 | 1 1 1 0<br>1 0 1 1 | 1 1 1 1<br>1 1 1 1 | | | | |
| 1 | 0 0I 0 0<br>0 0 0 0I | 1 0I 0 0<br>0 0 1 0I | 1 0I 1 0<br>1 0 1 0I | 1 0I 1 1<br>1 1 1 0I | 0 1I 1 1<br>1 1 0 1I | 1 1I 1 1<br>1 1 1 1I | | | |
| 2 | 0I 0I 0 0<br>0 0 0I 0I | 0I 0I 1 0<br>1 0 0I 0I | 0I 0I 1 1<br>1 1 0I 0I | 0I 1I 1 0<br>1 0 0I 1I | 0I 1I 1 1<br>1 1 0I 1I | 1I 1I 1 0<br>1 0 1I 1I | 1I 1I 1 1<br>1 1 1I 1I | | |
| 3 | 0I 0I 0I 0<br>0I 0 0I 0I | 0I 0I 0I 1<br>0I 1 0I 0I | 0I 1I 0I 0<br>0I 0 0I 1I | 0I 1I 0I 1<br>0I 1 0I 1I | 1I 1I 0I 0<br>0I 0 1I 1I | 0I 1I 1I 1<br>1I 1 0I 1I | 1I 1I 1I 0<br>1I 0 1I 1I | 1I 1I 1I 1<br>1I 1 1I 1I | |
| 4 | 0I 0I 0I 1I<br>0I 0I 0I 0I | 0I 1I 0I 0I<br>0I 0I 0I 1I | 0I 1I 0I 0I<br>0I 0I 0I 1I | 1I 1I 0I 0I<br>0I 0I 1I 1I | 1I 1I 0I 0I<br>0I 0I 1I 1I | 1I 1I 0I 0I<br>0I 0I 1I 1I | 1I 1I 1I 0I<br>1I 0I 1I 1I | 1I 1I 1I 0I<br>1I 0I 1I 1I | 1I 1I 1I 1I<br>1I 1I 1I 1I |

*Figure 11*

METHOD AND APPARATUS FOR DISPLAYING COLOR ON A COMPUTER OUTPUT DEVICE USING DITHERING TECHNIQUES

CROSS-REFERENCE TO RELATED APPLICATION

This application is a continuation of U.S. application Ser. No. 07/430,503 filed Oct. 31, 1989, now U.S. Pat. No. 5,138,503

TECHNICAL FIELD

This invention relates generally to a computer system for displaying color on a computer output device, and more specifically, to a method and apparatus for displaying the color using dithering techniques.

BACKGROUND ART

Computer systems output data in either monochrome or color formats. In certain applications, the display of data in color has many advantages over the monochrome display of data. The use of color allows for easy identification of certain data on a display. For example, a red field could mean data entered incorrectly, whereas a green field could mean data entered correctly. The use of colors also allows sophisticated multicolor graphs, charts, and diagrams to be displayed and printed. Finally, the use of color in an application has a particular aesthetic appeal to computer users that is similar to the appeal color television has over black-and-white television.

Computer systems typically support a variety of color output devices, including video displays and printers. Each of these output devices has differing characteristics. For example, the IBM 8514/A graphics adapter, which provides an interface between the computer and the display, provides the capability to display over 256,000 colors, but only 256 different colors can be displayed at a time. The IBM Enhanced Graphics Adapter (EGA) can display 64 different colors, but only 16 colors can be displayed at a time. When using these adapters, the program sending data to the adapter must specify which colors are the "active" colors; that is, the colors that currently are selected for display.

Each application program that displays color data must accommodate the differences in the number of active colors the various graphics adapters support. Systems software, such as Microsoft's Windows and Presentation Manager, provides a device-independent application programming interface. A developer of application programs can use standard systems routines to display information on a color output device. The systems software adjusts the data to accommodate the differing characteristics of the graphics adapter, so the application programmer need not be concerned about the differing characteristics of the graphics adapters.

Color graphics adapters normally have three basic color components: red, green, and blue. Each picture element (pel) on a display can be set to any one of the active colors by setting each color component, referred to as a red-green-blue (RGB) value. The intensity of each color can be varied. For example, a low-intensity red value would appear as dim red and a high-intensity red value would appear as bright red. The IBM 8514/A can display 64 different intensity levels of each color, but the IBM EGA can display only 3 different intensity levels for each color.

The IBM 8514/A has 256 active colors. Each active color can be represented in binary form using 8 bits. Each pel has associated with it an 8-bit value representing the active color to be displayed at that pel. By standard programming convention, the 8 bits are divided into 3 bits for red, 3 bits for green, and 2 bits for blue. Thus, eight different intensities of red and green are active, but only four intensities of blue are active. The IBM EGA has only 16 active colors. Thus, each pel has an associated 4-bit value. By standard programming convention, there is one red bit, one green bit, one blue bit, and one intensity bit. The intensity bit selects either high or low intensity for all the colors. Thus, the three colors of a given pel can be displayed either in all high intensity or in all low intensity.

The device-independent application program interfaces provided by systems software can support a much larger number of active colors than is typically supported by graphics adapters that are used on personal computers. For example, the Microsoft Windows program supports over 16 million active colors. An application program using Windows can specify 8 bits of red, 8 bits of green, and 8 bits of blue. Each 8-bit value represents an intensity level of the color between 0 and 255. To display bright red at a pel, the application would select an RGB value of high-intensity red and of zero intensity green and blue, which is represented as (255,0,0). To display half intensity magenta (purple), the application may select an RGB value of (128,0,128), that is, half-intensity red and blue and zero intensity green.

The systems software maps the 8-bit values to the active colors of the graphics adapters. In computer systems using the IBM 8514/A, the systems software maps the three 8-bit values to one 8-bit value and for systems using the IBM EGA, it maps to one 4-bit value.

This mapping results in undesirable effects. An application may specify similar shades of a color using the three 8-bit values. However, the systems software may map the similar, but different, shades to the same active color. For example, the systems software maps the 256 possible intensity levels for green and blue to just 8 intensity levels for the IBM 8514/A. Thus, typically 32 different application-specified intensities are actually displayed at the same intensity.

It would be desirable to have a graphics adapter that would support 256 different intensity levels for each of the three colors. This would alleviate this undesirable effect, but would require sophisticated graphics adapters not affordable by the typical personal computer user.

It would also be desirable to have a system that would effectively increase the active colors for the existing graphics adapters.

DISCLOSURE OF THE INVENTION

It is an object of the present invention to provide a method and system for effectively increasing the number of active colors supported by a graphics device.

It is another object of the present invention to provide a method and system for efficiently mapping the application-specified colors to the increased number of effective active colors.

These and other objects, which will become apparent as the invention is more fully described below, are obtained by an improved method and system for mapping application-specified colors to the active colors of a graphics adapter. The human eye cannot, in general, differentiate individual pels on a display because the pels are too small. Thus, a display filled with alternating red and blue pels would appear to be purple. In a preferred embodiment, each specified color is mapped to a 2-by-2 pel grid. By appropriately selecting different active colors in each pel (a fill pattern) of the grid, the method and system can effectively, at least to the human eye, display up to 64 times the number of active colors supported by the graphics adapters.

BRIEF DESCRIPTION OF THE DRAWINGS

FIG. 1 shows the mapping of an 8-bit intensity value for blue to a 2-bit intensity value.

FIG. 2 shows the 8-bit setting of the RRRGGGBB values in prior systems when RGB equals (0,0,128).

FIG. 3 shows a super-pel and associated numbering.

FIG. 4*a* shows the setting of the RRRGGGBB values by the present invention when RGB equals (0,0,128).

FIGS. 4*b*, 4*c*, and 4*d* show the filling pattern for the color blue when one, two, and three pels, respectively, are set to the next higher mapped intensity.

FIG. 5 shows the setting of the RRRGGGBB values by a system that uses no diagonal assignment when RGB equals (0,0,128).

FIG. 11 shows a preferred embodiment of the 2-by-4_ table.

DETAILED DESCRIPTION OF THE INVENTION

IBM 8514/A Dithering

Figure 6A:
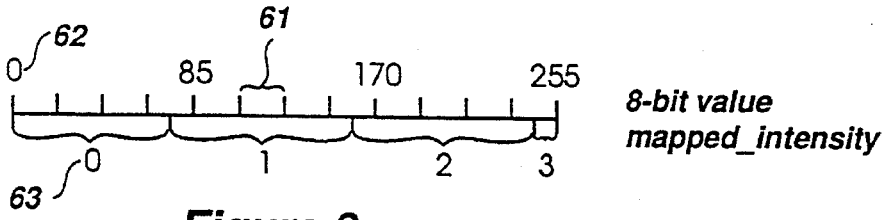
FIG. 6*a* shows the mapping from an 8-bit intensity value to a mapped intensity.

The IBM 8514/A has 256 active colors, which is represented by standard programming convention by 3 bits of red, 3 bits of green, and 2 bits of blue (RRRGGGBB). This allows for eight intensities of red and green and four intensities of blue to be active. In prior systems, the systems software receives the three 8-bit values from the application program. These prior systems map the 8-bit value representing red to a 3-bit value, the 8-bit value representing green to a 3-bit value, and the 8-bit value representing blue to a 2-bit value. FIG. 1 shows the mapping for the color blue. An 8-bit value between 0 and 42 is mapped to 0, between 43 and 127 is mapped to 1, between 128 and 212 is mapped to 2, and between 213 and 255 is mapped to 3. If the RGB value is (0,0,128), then the blue intensity for each pel is set to the mapped value of 2, as shown in FIG. 2. However, the actual intensity should be approximately halfway between 1 and 2.

The dithering system of the present invention provides a more accurate display of the colors that are selected by an application program to fill an area of the output device. The dithering system logically divides a display 30 (or area to be filled) into groups of 2-by-2 pels, called a "super-pel" 31, as shown in FIG. 3. The system determines a mapped intensity for each color (red, green, and blue), which, for blue, is approximately the integer portion of the 8-bit value times 3 divided by 255 (i.e., int (blue*3/255)). The possible mapped intensities for blue are 0, 1, 2, and 3. The system also determines the next higher mapped intensity, which is one greater than the determined mapped intensity. If the 8-bit number represents an intensity approximately one-quarter the way from the mapped intensity to the next higher mapped intensity, then three pels of the super-pels are set to the mapped intensity and one pel is set to the next higher mapped intensity. Similarly, if the 8-bit number represents an intensity approximately one-half the way from the mapped intensity to the next higher mapped intensity, then two pels of the super-pels are set to the mapped intensity and two pels are set to the next higher intensity. If the 8-bit number represents an intensity approximately three-quarters the way from the mapped intensity to the next higher mapped intensity, then one pel of the super-pel is set to the mapped intensity and three pels are set to the next higher intensity. This results in the effective display of three intensities of the color blue between each of the mapped intensities of the prior systems. Thus, the present invention effectively displays three times as many intensities of the color blue as the prior systems. For example, if the RGB value is (0,0,128), as discussed above, the dithering system of the present invention fills the display as shown in FIG. 4*a*. The dithering system sets each super-pel a value of (2,1,1,2) for the color blue intensity. In a preferred embodiment, the system sets the values in the super-pels in a diagonal pattern. If one pel has the next higher mapped intensity (represented as "B+1"), then Pel4 is set to the higher intensity, as shown in FIG. 4*b*. If two pels have the next higher mapped intensity, then Pel4 and Pel1 are set to the higher intensity, as shown in FIG. 4*c*. If three pels have the next higher intensity, then Pel4, Pel1, and Pel3 are set to the higher intensity, as shown in FIG. 4*d*. The assigning of the higher intensity in a diagonal pattern tends to minimize the number of columns that contain a solid color. FIG. 5 shows the assignment of blue intensities that is not diagonal. It has been found that the diagonal setting results in the more uniform appearance of the color, and is therefore preferred for most applications.

Figure 6B:
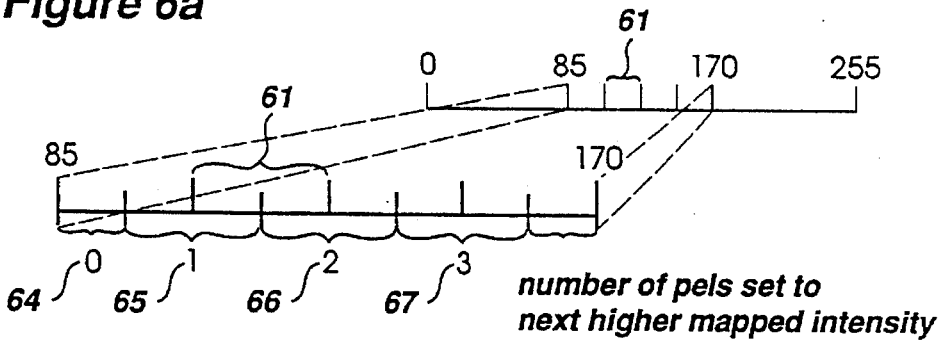
FIG. 6*b* shows the mapping to determine the number of pels in a super-pel to set to the next higher mapped intensity.

FIGS. 6*a* and 6*b* show the manner in which the 8-bit blue intensity value is mapped to the super-pel in a preferred embodiment. The intensity scale is logically divided into three regions: 0 to 84, 85 to 169, 170 to 255. Each of these regions is logically subdivided into four subregions, giving a total of 12 subregions 61, as shown in FIG. 6*a*. Each subregion has a width equal to 255 divided by 12 (i.e., 255/12). When the dithering system of the present invention inputs a blue value, it generates a mapped intensity. FIG. 6*a* shows the mapping from the 8-bit values 62 to the 2-bit values 63. At least one pel in each super-pel is set to the mapped intensity. The remaining pels are set to the value of the next higher mapped intensity. The dithering system of the present invention determines the number of pels to set to the next higher mapped intensity, as shown in FIG. 6*b*. For example, if the mapped intensity is 1 and if the 8-bit value is approximately halfway between 85 and 170, then two pels 66 of the super-pel are set to the next higher mapped intensity. Similarly, if the 8-bit value is approximately one-quarter of the way between 85 and 170, then only one pel 65 of the super-pel is set to the next higher mapped intensity; and if the 8-bit value is approximately three-quarters of the way between 85 and 170, then three pels 67 of the super-pel are set to the next higher mapped intensity.

In a preferred embodiment, the red and green intensities are mapped to a 3-bit value. The mapping is similar to the mapping for the blue intensity, except that there are 28 (7 times 4) subregions.

TABLE 1

| | | |
|---|---|---|
| 1 | mapped := | $\text{int}\left[\left(\text{blue}+\frac{255}{24}\right)*\frac{12}{255}\right]$ |
| 2 | base_color := int(mapped/4), | |
| 3 | rem_color := mapped.rem.4 | |
| 4 | ipc2 := base_color | |
| 5 | if rem_color = 3 | then ipc3 := base_color + 1<br>else ipc3 := base_color |
| 6 | if rem_color >= 2 | then ipc1 := base_color + 1<br>else ipc1 := base_color |
| 7 | if rem_color >= 1 | then ipc4 := base_color + 1<br>else ipc4 := base_color |
| 8 | mapped := | $\text{int}\left[\frac{(\text{blue} * 12)+128+6}{256}\right]$ |

TABLE 2

| | | |
|---|---|---|
| 1 | mapped := | $\text{int}\left[\left(\text{green}+\frac{255}{56}\right)*\frac{28}{255}\right]$ |
| 2 | base_color := int(mapped/4) | |
| 3 | rem_color := mapped.rem.4 | |
| 4 | ipc1 := ipc1.or.(base_color.sh1.2) | |
| 5 | if rem_color = 3 | then ipc4: = ipc4. or. ( (base_color + 1).sh1.2)<br>else ipc4: = ipc4. or. (base_color.sh1.2) |
| 6 | if rem_color >= 2 | then ipc2: = ipc2. or. ( (base_color + 1).sh1.2)<br>else ipc2: = ipc2. or. (base_color.sh1.2) |
| 7 | if rem_color >= 1 | then ipc3: = ipc3. or. ( (base_color + 1).sh1.2)<br>else ipc3: = ipc3. or. (base_color.sh1.2) |
| 8 | mapped := | $\text{int}\left[\frac{(\text{green} * 28)+128+14}{256}\right]$ |

TABLE 3

| | | |
|---|---|---|
| 1 | mapped := | $\text{int}\left[\left(\text{red}+\frac{255}{56}\right)*\frac{28}{255}\right]$ |
| 2 | base_color := int(mapped/4) | |
| 3 | rem_color := mapped.rem.4 | |
| 4 | ipc3 := ipc3.or.(base_color.sh1.5) | |
| 5 | If rem_color = 3 | then ipc2: = ipc2. or. ( (base_color + 1).sh1.5)<br>else ipc2: = ipc2. or. (base_color.sh1.5) |
| 6 | if rem_color >= 2 | then ipc4: = ipc4. or. ( (base_color + 1).sh1.5)<br>else ipc4: = ipc4. or. (base_color.sh1.5) |
| 7 | if rem_color >= 1 | then ipc1: = ipc1. or. ( (base_color + 1).sh1.5)<br>else ipc1: = ipc1. or. (base_color.sh1.5) |
| 8 | mapped := | $\text{int}\left[\frac{(\text{red} * 28)+128+14}{256}\right]$ |

Tables 1, 2, and 3 show pseudo-code that implements a preferred embodiment of the present invention. The variables ipc1, ipc2, ipc3, and ipc4 are set to the RRRGGGBB values to be stored in Pel1, Pel2, Pel3, and Pel4, respectively. Table 1 shows the pseudo-code for the mapping of the 8-bit blue intensity to the super-pel setting. Referring to line 1, the value 255 divided by 24 (i.e., 255/24) is added to the blue intensity to effect rounding. That sum is multiplied by 12 divided by 255 (i.e., 12/255) to effect the mapping to a number in the range of 0 to 12. The integer part of this product is stored in the variable mapped. At line 2, the variable mapped is divided by 4 (i.e., mapped/4). This division maps the 8-bit value down to a 2-bit value, which is stored in the variable base_color. At line 3, the remainder of mapped divided by 4 is stored in the variable rem_color. Thus, base_color contains the mapped intensity level that at least one pel in the super-pel will be set to, and rem_color indicates whether one, two, or three pels in the super-pel will be set to the next higher mapped intensity. At line 4, the system sets ipc2 to the base_color to indicate that Pel2 will be set to the mapped intensity. Lines 5 through 7 implement a preferred filling order for those pels of the super-pel that are to be set to base_color+1. At line 5, if rem_color equals 3, then the system sets ipc3 equal to base_color+1, else it sets ipc3 equal to base_color. Thus, if three pels are to be set to the higher intensity, then ipc3 contains the next higher mapped intensity, else ipc3 contains the mapped intensity. At line 6, if rem_color is greater than or equal to 2, then the system sets ipc1 equal to base_color+1, else it sets ipc1 equal to base_color. At line 7, if rem_color is greater than or equal to 1, then the system sets ipc4 equal to base_color+1, else it sets ipc4 equal to base_color. Upon completion of line 7, the variables ipc1, ipc2, ipc3, and ipc4 contain in bits 0 and 1 (the least significant bit of an 8-bit value is bit 0) the settings for the blue intensity for each pel in the super-pel.

Tables 2 and 3 contain analogous pseudo-code for mapping the red and green intensity values to the super-pel intensities. The system shifts the intensity mapping as appropriate to position the mapped intensities in the RRRGGGBB formatted byte. Bits 2–4 contain the green intensity value, and bits 5–7 contain the red intensity value. The system also sets ipc1, ipc2, ipc3, and ipc4 to effect the diagonal mapping as discussed above.

Figure 7:
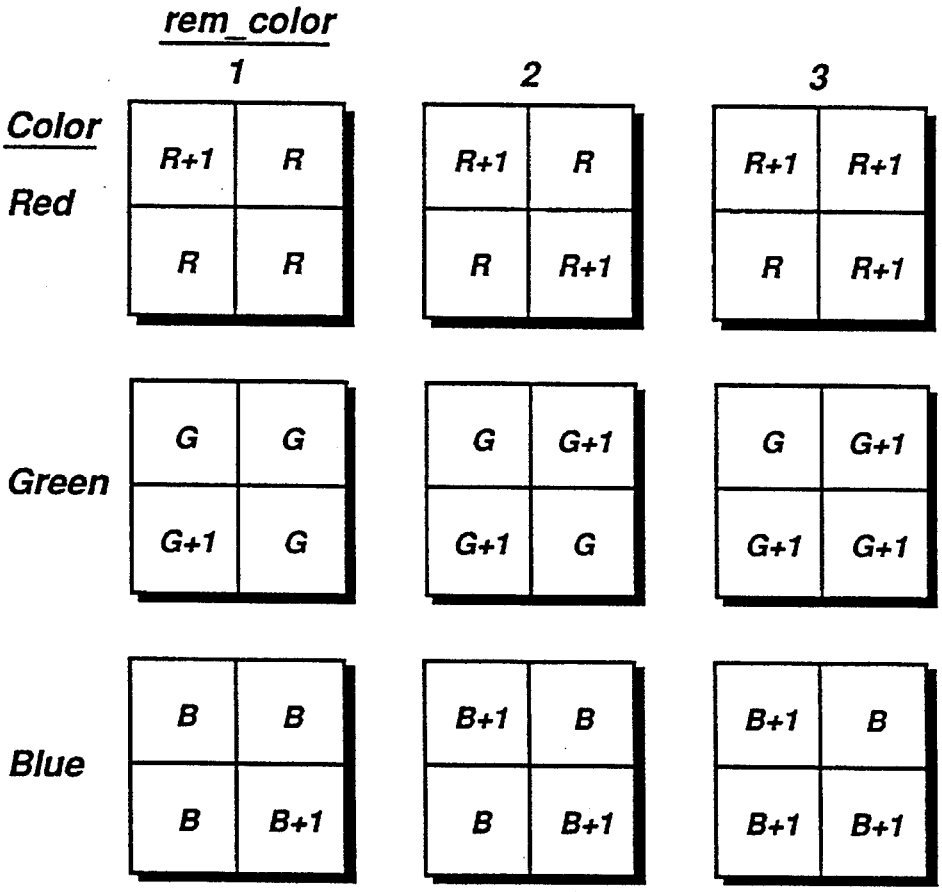
FIG. 7 shows the diagonal filling order of the next higher mapped intensities for each of the colors.

In a preferred embodiment, each color of the three colors has a different diagonal filling order. FIG. 7 shows a preferred filling order. If rem_color equals 1, then for red, Pel1 is set to the next higher mapped intensity; for green, Pel3 is set to the next mapped intensity; and for blue, Pel4 is set to the next mapped intensity. Similarly, the second and third columns show the filling order when rem_color equals 2 and 3, respectively.

Tables 1, 2, and 3 at line number 8 show a preferred embodiment of the calculation of the mapped variable. In a computer with an 8-bit byte, division by 256 is efficiently accomplished without executing the hardware division instruction. Division by 255, on the other hand, requires the use of the division instruction. The preferred embodiment at line number 8 represents an approximation of the result given by line number 1. Since the approximation can be implemented without the use of a division instruction, a computer can calculate the approximation significantly faster than the exact value to a degree of accuracy that may be acceptable.

IBM EGA Dithering (Point Count Dithering)

The IBM EGA uses four bits per pel to represent the 16 colors that can be displayed. By standard programming convention, one bit represents red, one bit represents green, one bit represents blue, and one bit represents the intensity level. The present invention uses a technique called "point count dithering" to determine the color settings for each bit in a super-pel.

The IBM EGA has only one intensity bit per pel. Consequently, each of the three colors cannot independently be set to high or low intensity. If the intensity bit is high, then each of the colors that are set are displayed at high intensity. Conversely, if the intensity bit is low, then each of the colors that are set are displayed at low intensity. If, however, a color is not set, then it is not displayed regardless of the setting of the intensity bit.

A preferred embodiment of the present invention maps each of the three 8-bit color intensity levels to a number between 0 and 8. The system first determines the number of intensity bits to set in the super-pels based on these mapped numbers. If the largest mapped number (highest intensity) is between 0 and 4, then no intensity bits are set. If the largest mapped number is 5, 6, 7, or 8, then 1, 2, 3, or 4 intensity bits in the super-pel are set, respectively. The system then determines for each of the three colors which pels in the super-pel to set.

Figure 10:
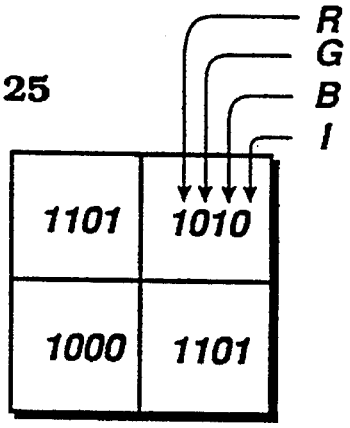
FIG. 10 shows a sample of super-pel setting when RGB equals (190,130,25).

The system sets the bits for the colors so that the point count of each color equals the mapped number (which is a number between 0 and 8). In a preferred embodiment, the selection of the active colors and the adjustment of the contrast on the EGA 8514 monitor are coordinated to achieve the optimum effects of this point count dithering technique. If the intensity bit in a pel is set, then setting the bit for a color in that pel counts as two points for that color. If the intensity bit in a pel is not set, then setting the bit for a color in that pel counts as one point for that color. If the bit for a color is not set in a pel then, regardless of the intensity setting, that pel counts as no points for that color. The sum of the points for a color in a super-pel is the point count for that color. FIG. 10 shows a super-pel in which the intensities of Pel1 and Pel4 are set to one. Consequently, the count for any color bit that is set in those pels is two. Pel2 and Pel3 have an intensity of zero; thus the count for any color that is set in those pels is one.

TABLE 4

1 mapped_red := $\text{int}\left[\frac{8 * \text{red}}{255} + 1/2\right]$ 2 mapped_green := $\text{int}\left[\frac{8 * \text{green}}{255} + 1/2\right]$ 3 mapped_blue := $\text{int}\left[\frac{8 * \text{blue}}{255} + 1/2\right]$

```
4 max_mapped :=max(mapped_red, mapped_green, mapped_blue)
5 if max_mapped <= 4          then intensity :=0
                              else intensity := max_mapped - 4
6 if mapped_red or mapped_green in alterante (intensity)
                        then table := 2-by-4_table
                        else table := 2-by-2_table
7 intensity_super_pel := table (intenisty , 0)
8 red_super_pel := table (intensity, mapped_red)
9 green_super_pel := table (intensity, mapped_green)
10 blue_super_pel := table (intensity, mapped_blue)
```

11 mapped_red := $\text{int}\left[\frac{\text{int}(\text{red}/16) + 1}{2}\right]$ Table 4 shows pseudo-code that determines the settings in the super-pels. Lines 1 through 3 map the 8-bit color intensities to a value ranging from 0 to 8 and store the mapped value in variables mapped_red, mapped_green, and mapped_blue. The one-half that is added in lines 1 through 3 is a rounding factor. At line 4, the system sets max_mapped equal to the maximum of the mapped values. If max_mapped is greater than 4, then the system will set at least one intensity bit in the super-pel. At line 5, the system calculates the number of intensity bits that will be set in the super-pel and stores the number in the variable intensity.

Figure 8:
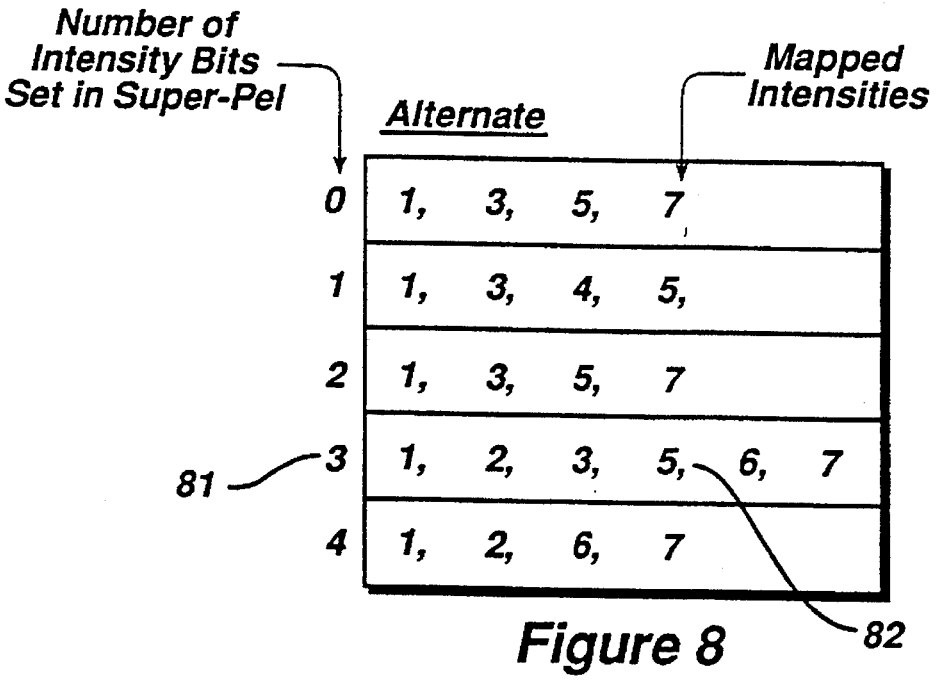
FIG. 8 shows a preferred embodiment of the alternate table.

Empirical research indicates that certain combinations of red and green are more accurately displayed in a 2-by-4 super-pel than a 2-by-2 super-pel. A 2-by-4 super-pel contains eight pels. FIG. 8 contains a table named alternate. The table alternate contains a set of mapped intensities that are more accurately displayed in a 2-by-4 super-pel. The set of values varies, based on the number of intensity bits set in the 2-by-2 super-pel. For example, if intensity 81 equals 3 and mapped_green or mapped_red 82 equals 5, then a 2-by-4 super-pel in a preferred embodiment is a more appropriate super-pel size. At line 6, the system determines whether the value corresponding to mapped_green or mapped_red is in the alternate table entry indexed by intensity. If either mapped_green or mapped_red is in the alternate table, then the system selects the 2-by-4_table by setting table equal to the 2-by-4_table, else the system selects the 2-by-2_table.

Figure 9:
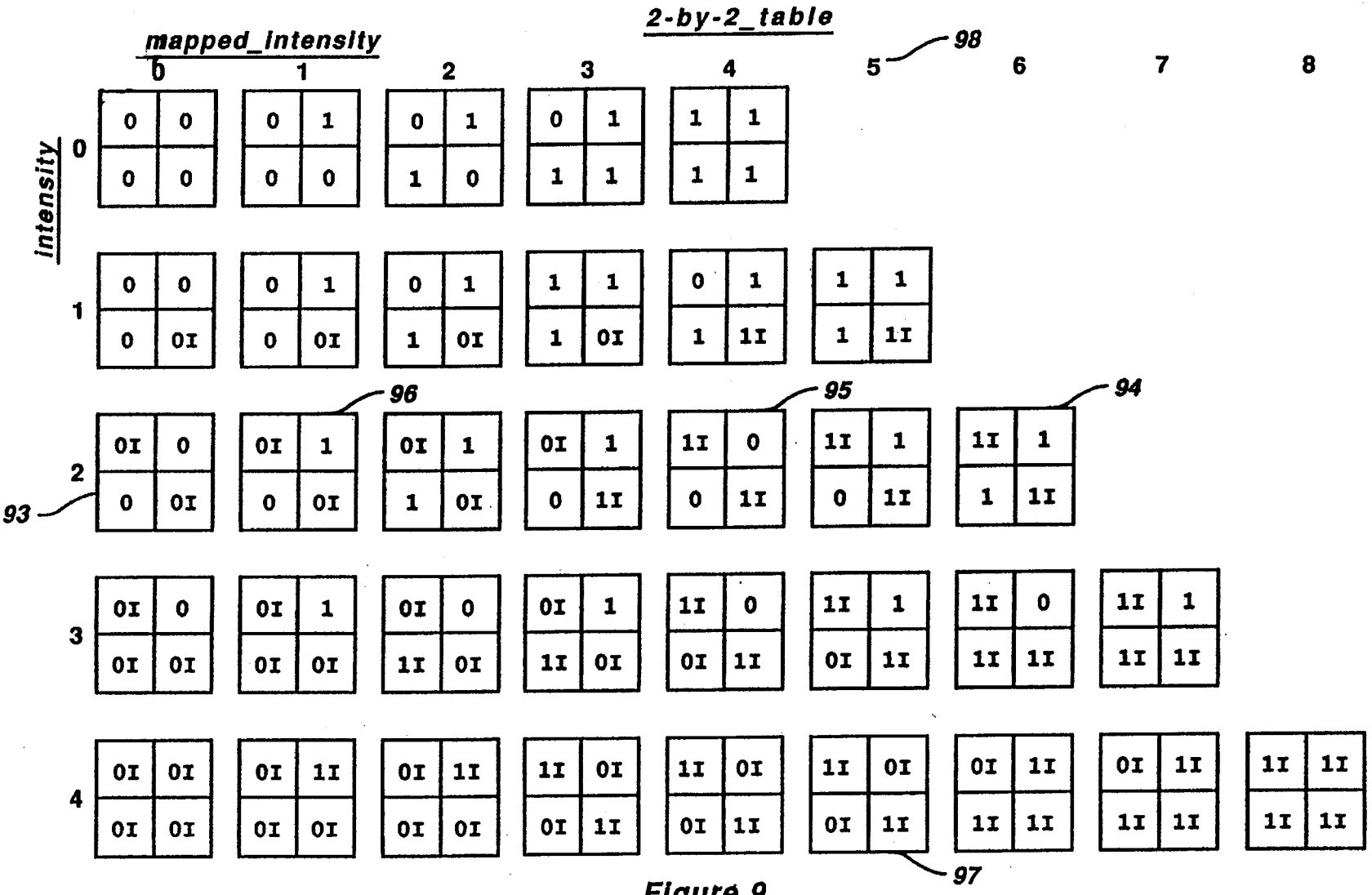
FIG. 9 shows a preferred embodiment of the 2-by-2_ table.

FIG. 9 shows the data of the 2-by-2_table. This table represents 2-by-2 super-pels and is indexed by intensity and a mapped_intensity. For example, if the system is passed an RGB value of (190,130,25), then the variable settings as the system starts line 7 are shown in FIG. 10. At line 7, the system accesses table and determines which pels are to have their intensity bit set. The "I"s in the table entries indicate that the corresponding intensity bits in the super-pel are to be set. Continuing with the example of FIG. 10, the system accesses row 2 and column 0 indicated as 93 of FIG. 9. Since there is an "I" in Pel1 and Pel4, the system sets the corresponding intensity bit in the super-pel and clears the other intensity bits. At line 8, the system determines which pels are to have their red bit set by accessing table. The "1" in the super-pel entries of the table indicates that the bit is to be set and the "0" indicates that the bit is to be cleared. In the example of FIGS. 9 and 10, the mapped_red value is 6, so the system accesses column 6 of row 2 indicated as 94 to determine which red bits to set. The system sets the red bit for each of the pels because each pel of the entry contains a "1." At line 9, the system determines which pels are to have their green bit set by system accessing table. Continuing with the example, since the mapped_green value is 4, the system accesses column 4 of row 2 indicated as 95 in FIG. 9 to determine which green bits to set. The system sets the green bits for Pel1 and Pel4 and clears the green bits for Pel2 and Pel3. At line 10, the system determines which pels are to have their blue bit set by accessing table. In the example, since the mapped_blue value is 1 the system accesses column 1 of row 2 indicated by 96 in FIG. 9 to determine which blue bits to set. The system sets the blue bit for Pel2 and clears the blue bit for Pel1, Pel3, and Pel4. The super-pel shown in FIG. 10 shows the RGBI setting for the example.

The system uses a similar method when it accesses the 2-by-4_table as shown in FIG. 11. Conceptually, the only difference is that the super-pel is 2-by-4 pels rather than 2-by-2 pels.

The system derives the 2-by-2_table using a point count technique. The point count of a super-pel for a particular color (red, green, or blue) is derived by counting the points for each pel. Each pel that contains a 0 for the color counts as 0 points; each pel that contains a 1 for the color and in which the pel intensity is not set counts as 1 point; and each pel that contains a 1 for the color and in which the pel intensity is set counts as 2 points. The point count of each super-pel in a particular column of the 2-by-2_table is equal to the column index, except for the pels in row 4. For example, the point count of each of the entries in column 5 equals 5 indicated by 98 in FIG. 9, except for row 4. In the fourth row, since each intensity bit in the super-pels is set, the point count can only be a multiple of two. Consequently, a preferred embodiment of the present invention uses even point counts when all intensity bits in a super-pel are set. The super-pel 97 has a point count of four rather than five. The system also uses the point count technique in each of the two 2-by-2 super-pels that compose the entries of the 2-by-4_table.

Although the point count dithering technique has been described in terms of graphics adapter with four bits per pel, this technique is a general technique that can be used when there are more than four bits per pel. For example, if the graphics adapter has eight bits per pel, the two bits can represent the intensity level, two bits can represent the color red, two bits can represent the color green, and two bits can represent the color blue. Within each pel can be displayed up to 12 different intensities of a color (i.e., four intensity levels times three color levels) and within a super-pel can be displayed up to 48 different intensity levels of a color. In a preferred embodiment, each of the three 8-bit color values are mapped to a value between 0 and 48. The maximum of these mapped values is used to determine the intensity setting for each pel in the super-pel. For example, if the maximum mapped value is 40, then the intensity setting may be (3,3,3,1). Once the intensity setting is established then the color values are determined so that the point count equals (or comes as close as possible to) the mapped values. In a preferred embodiment, the point count is determined by the following formula:

Point Count:=(3* intensity)+color

For example, if the intensity is one and the color is 3, the point count is 6.

It is apparent to one skilled in the art that the particular arrangement of the pels within each entry of the 2-by-2_ table or the 2-by-4_table can be varied and still be within the spirit of the present invention.

It is also apparent to one skilled in the art that rather than using a table to look up the bit setting, the RGBI values can be calculated by the system using a point count method.

It is also apparent to one skilled in the art that a super-pel may be defined to contain any number of pels.

Although the present invention has been described in terms of a preferred embodiment, it is not intended that the invention be limited to this embodiment. Modification within the spirit of the invention will be apparent to those skilled in the art. The scope of the present invention is defined by the claims which follow.

I claim:

1. A method of filling an area in a color output device, the device being pel addressable, each pel having a red bit representing the color red, a green bit representing the color green, a blue bit representing the color blue, and an intensity level bit representing the intensity level, wherein the intensity level bit controls the intensity level of the color red, the color green, and the color blue for the pel, the device being logically divided into super-pels, comprising the steps of:

designating three intensity values, one intensity value associated with the color red, one intensity value associated with the color green, and one intensity value associated with the color blue;

mapping each designated intensity value to a mapped number representing a ratio of the designated intensity value to a maximum intensity value, one mapped number associated with the color red, one mapped number associated with the color green, and one mapped number associated with the color blue;

determining a number of intensity level bits in each super-pel to set based on a maximum mapped number of the three mapped numbers, wherein the number of intensity level bits to set is in proportion to an amount by which the maximum mapped number exceeds one half;

forming a fill pattern based on the intensity level bits, red bits, green bits, and blue bits of a super-pel; and setting the intensity level bits, red bits, green bits, and blue bits of each super-pel to effect the filling of the area based on the fill pattern.

2. The method of claim 1 wherein the step of forming a fill pattern comprises the steps of:

selecting the pels of a super-pel that are to have their intensity level bit set based on the determined number of intensity level bits;

selecting the pels of a super-pel that are to have their red bit set wherein a red point count of the super-pel equals the mapped number associated with the color red times a number of pels in the super-pel, the red point count of the super-pel is a sum of the red point count of each pel being zero when the red bit is not set, being one half when the red bit is set and the intensity level bit is not set, and being one when the red bit is set and the intensity level bit is set;

selecting the pels of a super-pel that are to have their green bit set wherein a green point count of the super-pel equals the mapped number associated with the color green times a number of pels in the super-pel, the green point count of the super-pel is a sum of the green point count of each pel being zero when the green bit is not set, being one half when the green bit is set and the intensity level bit is not set, and being one when the green bit is set and the intensity level bit is set; and selecting the pels of a super-pel that are to have their blue bit set wherein a blue point count of the super-pel equals the mapped number associated with the color blue times a number of pels in the super-pel, the blue point count of the super-pel is a sum of the blue point count of each pel being zero when the blue bit is not set, being one half when the blue bit is set and the intensity level bit is not set, and being one when the blue bit is set and the intensity level bit is set.

3. The method of claim 1 wherein the step of setting the selected intensity level bits, red bits, green bits, and blue bits of each super-pel according to the fill pattern includes replacing the formed fill pattern with an alternate fill pattern for certain combinations of color intensities.

4. The method of determining the fill pattern for a color output device, the device being pel addressable, each pel having a red bit representing the color red, a green bit representing the color green, a blue bit representing the color blue, and an intensity level bit representing the intensity level, wherein the intensity level bit controls the intensity level of the color red, the color green, and the color blue for the pel, the device being logically divided into super-pels, comprising the steps of:

receiving three intensity values, one intensity value associated with the color red, one intensity value associated with the color green, and one intensity value associated with the color blue;

determining a number and arrangement of bits representing the intensity level to set in each super-pel based on a highest intensity value of the three intensity values, the determined number being proportional to an amount in which the highest intensity level exceeds one half of a maximum possible intensity value; and for each color, determining a number and arrangement of bits representing the color to set in each super-pel such that a point count of the color for the super-pel approximately equals the intensity value for the color divided by the maximum possible intensity value times a number of pels in the super-pel.

5. The method of claim 4 wherein the step of determining the number and arrangement of bits representing the respective colors includes the steps of:

assigning a pel point count of the color to each pel in the super-pel wherein the pel point count is assigned a value of zero when the color bit is not set, the pel point count is assigned a value of one half when the color bit is set and the intensity level bit is not set, and the pel point count is assigned a value of one when the color and the intensity level bits are set in the pel; and determining the super-pel point count for the color by summing the pel point counts for the color for each pel in the super-pel.

6. An apparatus for filling an area in a color output device, the device being pel addressable, each pel having a red bit representing the color red, a green bit representing the color green, a blue bit representing the color blue, and an intensity level bit representing the intensity level wherein the intensity level bit controls the intensity level of the color red, the color green, and the color blue for the pel, the device being logically divided into super-pels, which comprises:

means for designating three intensity values, one intensity value associated with the color red, one intensity value associated with the color green, and one intensity value associated with the color blue;

means for mapping each designated intensity value to a mapped number representing a ratio of the designated intensity value to maximum intensity value, one mapped number associated with the color red, one mapped number associated with the color green, and one mapped number associated with the color blue;

means for determining a number of intensity level bits in each super-pel to set based on a maximum mapped number of the three mapped numbers, wherein the number of intensity level bits to set is in proportion to an amount by which the maximum mapped number exceeds one half;

means for forming a fill pattern based on the intensity level bits, red bits, green bits, and blue bits of a super-pel; and means for setting the intensity level bits, red bits, green bits, and blue bits of each super-pel to effect the filling of the area based on the fill pattern.

7. The apparatus of claim 6 wherein the means for forming a fill pattern comprises:

means for selecting the pels of a super-pel that are to have their intensity level bit set based on the determined number of intensity level bits;

means for selecting the pels of a super-pel that are to have their red bit set wherein a red point count of the super-pel equals the mapped number associated with the color red times a number of pels in the super-pel, the red point count of the super-pel is a sum of the red point count of each pel being zero when the red bit is not set, being one half when the red bit is set and the intensity level bit is not set, and being one when the red bit is set and the intensity level bit is set;

means for selecting the pels of a super-pel that are to have their green bit set wherein a green point count of the super-pel equals the mapped number associated with the color green times a number of pels in the super-pel, the green point count of the super-pel is a sum of the green point count of each pel being zero when the green bit is not set, being one half when the green bit is set and the intensity level bit is not set, and being one when the green bit is set and the intensity level bit is set; and means for selecting the pels of a super-pel that are to have their blue bit set wherein a blue point count of the super-pel equals the mapped number associated with the color blue times a number of pels in the super-pel, the blue point count of the super-pel is a sum of the blue point count of each pel being zero when the blue bit is not set, being one half when the blue bit is set and the intensity level bit is not set, and being one when the blue bit is set and the intensity level bit is set.

8. The apparatus of claim 6 wherein the means for setting the selected intensity level bits, red bits, green bits, and blue bits of each super-pel according to the fill pattern includes means for replacing the formed fill pattern with an alternate fill pattern for certain combinations of color intensities.

9. An apparatus for determining a fill pattern for a color output device, the device being pel addressable, each pel having a red bit representing the color red, a green bit representing the color green, a blue bit representing the color blue, and an intensity level bit representing the intensity level, wherein the intensity level bit controls the intensity level of the color red, the color green, and the color blue for the pel, the device being logically divided into super-pels, which comprises:

means for receiving three intensity values, one intensity value associated with the color red, one intensity value associated with the color green, and one intensity value associated with the color blue;

means for determining a number and arrangement of bits representing the intensity level to set in each super-pel based on a highest intensity value of the three intensity values, the determined number being proportional to an amount in which the highest intensity level exceeds one half of a maximum possible intensity value; and means for determining a number and arrangement of bits representing the color to set in each super-pel such that a point count of the color for the super-pel approximately equals the intensity value for the color divided by the maximum possible intensity value times a number of pels in the super-pel.

10. The apparatus of claim 9 wherein the means for determining the number and arrangement of bits representing the respective colors includes:

means for assigning a pel point count of the color to each pel in the super-pel wherein the pel point count is assigned a value of zero when the color bit is not set, the pel point count is assigned a value of one half when the color bit is set and the intensity level bit is not set, and the pel point count is assigned a value of one when the color and the intensity level bits are set in the pel; and means for determining the super-pel point count for the color by summing the pel point counts for the color for each pel in the super-pel.

11. A method in a computer system for setting intensity level bits of pels of a super-pel while filling an area on a color output device, the super-pel being a matrix with a number of pels, each pel consisting of a red bit representing the color red, a green bit representing the color green, a blue bit representing the color blue, and an intensity level bit representing the intensity level which controls the intensity level of the color red, the color green, and the color blue within the pel, the method comprising the steps of:

designating a red color value representing the intensity of the color red, a green color value representing the intensity of the color green, and a blue color value representing the intensity of the color blue;

selecting a highest color value from among the red color value, green color value, or blue color value;

determining a color percentage for the highest color value based on the highest color value in relation to a highest possible color value;

determining a number of pels of a super pel whose intensity level bits are to be set based on the color percentage, where the number of pels whose intensity level bits are to be set is proportional to an amount by which the color percentage exceeds 50%; and setting the intensity level bits in the determined number of pels of the super-pel.

12. A method in a computer system for setting color bits of pels of a super-pel, the super-pel being a matrix with a number of pels, each pel consisting of four bits, a red bit representing the color red, a green bit representing the color green, a blue bit representing the color blue, and an intensity level bit representing the intensity level which controls the intensity level of the color red, the color green, and the color blue for the pel, where a number of intensity level bits in the pels of the super-pel have already been selected to be set, the method comprising the following steps:

receiving three color values, one color value representing a percentage of the color red, one color value representing a percentage of the color green, and one color value representing a percentage of the color blue;

determining three mapped numbers, one for the color red, one for the color green, and one for the color blue based on the color values, each mapped number being approximately equal to the color value times the number of pels in the super-pel;

setting a number of intensity level bits in the super-pel in proportion to a ratio in which a maximum of the three mapped numbers exceeds one-half the number of pels in the super-pel; and setting the red bits, green bits, and blue bits in the super-pel so that a total point count for each color is approximately equal to the mapped number for the color, the total point count for a color being a sum of a point count for the color for each pel, the point count for the color for a pel being zero when the color bit is not set, being one half when the color bit is set and the intensity level bit is not set, and being one when the color bit is set and the intensity level bit is set.

13. A method in a computer system for displaying a color display device, the device having a number of pels, each pel having an intensity bit and a plurality of color bits, each color bit representing a different color, the intensity bit of each pel for controlling the intensity of each of the color bits in the pel, each bit being settable to low or high, the method comprising the steps of:

for each of the different colors, receiving an intensity value, each intensity value being within a minimum and a maximum intensity value for that color; and determining an intensity ratio that is the ratio of received intensity value to the maximum intensity value for that color;

selecting the intensity ratio with a largest value;

setting a number of intensity bits to high, the number set being in proportion to the amount in which the selected intensity ratio exceeds one half; and for each of the different colors, setting a number of color bits for the color to high such that a ratio of a total point count for the color to the number of pels of the device is approximately equal to the intensity ratio for that color, wherein each pel has a point-count for a color that is approximately equal to a fraction of full intensity based on the setting of the intensity bit and the color bit for that color.

14. The method of claim 13 wherein each pel with its intensity bit set to high and color bit for the color set to high has a point count of one, each pel with its intensity bit set to low and color bit for the color set to high is a point count of one half, and each pel with the color bit for the color set to low is a point count of zero.

15. A method in a computer system for displaying a color display device, the device having a number of pels, each pel having an intensity bit and a plurality of color bits, each color bit representing a different color, the intensity bit of each pel for controlling the intensity of each of the color bits in the pel, each bit being settable to low or high, each pel having a point count for each different color, a point count for a color being approximately equal to a fraction of full intensity based on the setting of the intensity bit and the color bit for that color, each color having a total point count that is a sum of the point counts of each pel for the color, the method comprising the steps of:

for each of the different colors, receiving an intensity value for the color;

selecting one of the intensity values having a highest value;

setting a number of intensity bits to high such that a ratio of the number of intensity bits set to high to the number of pels of the device is approximately equal to twice the selected intensity value divided by a maximum possible intensity value minus 1; and for each of the different colors, setting a number of color bits to high such that a ratio of the total point count for the color to the number of pels of the device is approximately equal to a ratio of the intensity value for the color to a maximum possible intensity value for the color.

16. The method of claim 15 wherein the point count for a color is zero when the color bit for the color is set to low, is one half when the color bit is set to high and the intensity bit is set to low, and is one when both the color bit for the color and the intensity bit are set to high.

17. A computer system having a memory storing dithering information, the computer system having a color display device with a number of pels, each pel having an intensity bit and a plurality of color bits, each color bit representing a different color, the intensity bit of each pel controlling the intensity of each of the color bits in the pel, each bit being settable to low or high, the computer system comprising:

means for receiving an intensity value for each of the different colors, each intensity value being within a minimum and a maximum intensity value for that color;

means for retrieving the maximum intensity value for each of the different colors from the dithering information stored in memory;

means for determining an intensity ratio that is the ratio of the received intensity value to the retrieved maximum intensity value for each of the different colors;

means for selecting the intensity ratio with a largest value;

means for determining the amount by which the selected intensity ratio exceeds one half, means for setting a number of intensity bits to high, the number set being in proportion to the determined amount in which the selected intensity ratio exceeds one half;

means for determining a total point count for each of the different colors; and means for setting a number of color bits for each of the different colors to high such that a ratio of the total point count for each color to the number of pels of the device is approximately equal to the intensity ratio for that color, wherein each pel has a point count for a color that is approximately equal to a fraction of full intensity based on the setting of the intensity bit and the color bit for that color.

18. The computer system of claim 17 wherein the total point count for a color is the sum of the point counts for each pel of the color, wherein the point count is one when the pel has its intensity bit set to high and the color bit for the color set to high, the point count is one half when the pel has its intensity bit set to low and the color bit set to high, and the point count is zero when the pel has the color bit set to low.

* * * * *